US008430625B2

(12) United States Patent
Golinkin et al.

(10) Patent No.: US 8,430,625 B2
(45) Date of Patent: Apr. 30, 2013

(54) CENTERLINE SUSPENSION FOR TURBINE INTERNAL COMPONENT

(75) Inventors: Samuel Golinkin, East Windsor, NJ (US); Russell V. Caggiano, Fairless Hills, PA (US); Timothy Ewer, East Windsor, NJ (US); Gennaro J. Diorio, Trenton, NJ (US); Michael J. Lipski, Trenton, NJ (US)

(73) Assignee: Siemens Demag Delaval Turbomachinery, Inc., Trenton, NJ (US)

( * ) Notice: Subject to any disclaimer, the term of this patent is extended or adjusted under 35 U.S.C. 154(b) by 1497 days.

(21) Appl. No.: 12/018,980

(22) Filed: Jan. 24, 2008

(65) Prior Publication Data

US 2008/0317591 A1 Dec. 25, 2008

Related U.S. Application Data

(60) Provisional application No. 60/944,886, filed on Jun. 19, 2007.

(51) Int. Cl.
*F01D 25/26* (2006.01)

(52) U.S. Cl.
USPC ..... 415/126; 415/134; 415/209.2; 415/214.1

(58) Field of Classification Search ..... 415/108, 415/126, 134, 209.2–209.4, 210.1, 213.1, 415/214.1; 403/335–338; 248/637, 646, 248/672

See application file for complete search history.

(56) References Cited

U.S. PATENT DOCUMENTS

| | | | | | |
|---|---|---|---|---|---|
| 2,112,738 | A * | 3/1938 | Doran | ..... | 415/108 |
| 3,746,463 | A * | 7/1973 | Stock et al. | ..... | 415/136 |
| 3,861,827 | A * | 1/1975 | Peabody et al. | ..... | 415/209.2 |
| 4,362,464 | A * | 12/1982 | Stock | ..... | 415/136 |
| 5,133,641 | A | 7/1992 | Groenendaal, Jr. et al. | | |
| 6,224,332 | B1 | 5/2001 | Leach et al. | | |
| 6,951,112 | B2 | 10/2005 | Czachor | | |
| 6,981,836 | B2 | 1/2006 | Tomko et al. | | |
| 7,581,922 | B1 * | 9/2009 | Morimoto et al. | ..... | 415/126 |

* cited by examiner

*Primary Examiner* — Christopher Verdier

(57) ABSTRACT

A centerline suspension arrangement (42) for a turbine (40). A turbine inner casing (44) is supported within an outer casing (46) via a support member (60) that includes an inner portion (62) contacting the inner casing and an outer portion (66) extending into a slot (68) formed in the outer casing. The support member is slid into an axially oriented slot (64) formed in the inner casing and is body bound therein with respect to radial movements, with the support member and the inner casing slot including opposed vertical support surfaces (82, 90) and a pair of oppositely facing opposed horizontal support surfaces (80, 88 and 86, 92). Thus, dead weight and operating loads from the inner casing are reacted through the support member and into the outer casing without the necessity for any bolting or other fastener attachment in the design load path between the support member and the inner casing.

12 Claims, 5 Drawing Sheets

CENTERLINE SUSPENSION FOR TURBINE INTERNAL COMPONENT

This application claims benefit of the 19 Jun. 2007 filing date of U.S. provisional patent application No. 60/944,886.

FIELD OF THE INVENTION

This invention relates generally to turbines, and more particularly to the centerline support of stationary turbine parts (cases, diaphragms, packing boxes, etc.), and in particular to a centerline suspension for a turbine inner casing within a turbine outer casing.

BACKGROUND OF THE INVENTION

Steam and gas turbines operate at high pressure and temperature conditions, and their constituent parts are subjected to significant mechanical and thermal stresses and deformations. In spite of such conditions, proper alignment and concentricity of turbine components must be maintained to ensure minimal clearances between stationary and rotating parts.

Turbine cases often utilize a multi-shell "matryoshka style" design consisting of several separate casings nested inside each other, thereby reducing peak stresses by dividing the entire pressure/temperature drop across several casings. An inner casing is aligned with an outer casing in the so-called "thermal cross" manner, i.e. with interconnections at two mutually perpendicular (e.g. horizontal and vertical) planes. The interconnection at the horizontal plane is made as the centerline suspension which carries both dead weight and reaction loads from rotor rotation and maintains alignment in the vertical direction, with vertical keys being located at the vertical plane for maintaining alignment in the horizontal direction.

FIG. 1 illustrates one such prior art horizontal joint suspension arrangement 10 wherein a portion of the inner casing flange 12 extends into a slot 14 formed in the outer casing. This arrangement functions well, but it requires an increase in the casing size and it significantly complicates the machining of the casing.

FIG. 2 illustrates another prior art horizontal suspension arrangement 16 that has been used for retaining the stationary components such as the diaphragms, labyrinth boxes, etc. inside of the outer casing. These stationary components are not bolted together at the joint. This suspension arrangement permits the upper half 20 of the outer casing to be used together with the upper halves of the diaphragms, labyrinth boxes, etc. during handling and assembly of the casing. The entire inside stationary component (upper and lower halves) is suspended in the lower half 21 of the outer casing by means of a support member 23 that is installed loosely into a shallow groove 27 which is formed in the lower half of the stationary part 30, and is welded 26 to this half. The protruding portion of the support member is extended into the slot 35 formed into the lower half 21 of the outer casing and is rested on the shim 31 which allows for proper alignment between the outer casing and the diaphragm, labyrinth box, etc. The upper half of the diaphragm, labyrinth box, etc. has a similar support member 24 installed into the shallow groove 28 and welded to this half with a shim 29 for alignment. The protruding portion of this support member is also extended into the slot 33 formed in the upper half 20 of the outer casing. This protruding portion is facing a separate key 18 that is attached to the upper half 20 of the outer casing by a bolt 22. The key 18 carries the weight of the upper half of the diaphragm, labyrinth box, etc. during handling and assembly operations as the upper half of the outer casing is being carried on and installed onto the lower half of the outer casing. During such handling operations, gap 15 will be closed as key 18 lifts against support member 24. After assembly and once the outer casing halves are bolted together, these components do not carry loads during turbine operation, since the upper half of the diaphragm, labyrinth box, etc. is resting directly on its lower half. This arrangement would not be useful as a casing support because it would be too flexible due to the loading of the bolted joint.

FIG. 3 illustrates another prior art horizontal support arrangement 32 incorporating a separate support member 34, but with the support member being bolted into the inner casing 36. While this arrangement is more robust than the arrangement of FIG. 2, it is nonetheless susceptible to significant vertical deflection when loaded under the weight of an assembled turbine and the reaction load from rotor rotation due to the moment loading imposed on the bolted support arrangement.

BRIEF DESCRIPTION OF THE DRAWINGS

The invention is explained in the following description in view of the drawings that show.

DETAILED DESCRIPTION OF THE INVENTION

Figure 4:
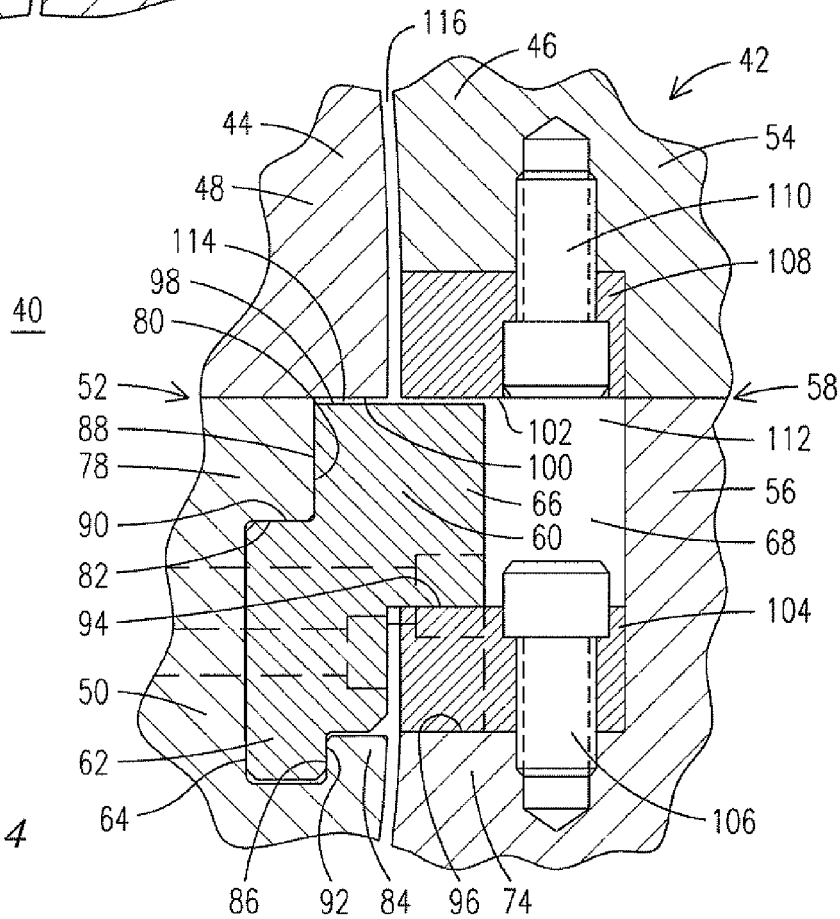
FIG. 4 is a cross-sectional view of an improved centerline suspension arrangement for turbine internal components.

FIG. 4 is a partial cross-sectional view of a turbine 40 illustrating an improved centerline suspension arrangement 42 for supporting an inner casing 44 in an outer casing 46. The turbine rotor is not illustrated but may be understood to have a longitudinal axis disposed in a direction perpendicular to the plane of the paper of FIG. 4 such that vertical dead weight loads would be exerted in a direction toward the bottom of FIG. 4. In one embodiment, this suspension arrangement may be used at two locations on each opposed horizontal side of the casing, and it may be complemented by one or more keys/keyways located along a vertical plane through the turbine rotor.

The inner casing includes an upper half 48 and a lower half 50 fastened along a horizontal joint 52. The outer casing also includes an upper half 54 and a lower half 56 fastened along a horizontal joint 58. A support member 60 interconnecting the inner and outer casings includes an inner portion 62 captured in a generally axially oriented slot 64 formed in the inner casing and an outer portion 66 extending from the inner portion into a slot 68 formed in the outer casing. Thus, the axially oriented slot 64 formed in the inner casing 44 provides a means for capturing the support member inner portion 62 within the turbine inner casing 44. The support member inner portion is body bound (i.e. lacks freedom of movement) in the inner casing slot with respect to radial loads, i.e. rotation or any vertical or horizontal movement of the support member except along a longitudinal axis that is parallel to the turbine rotor longitudinal axis (i.e. into or out of the plane of the paper of FIG. 4). The support member is free to move along its longitudinal axis through the inner casing slot. Thus, the support member is body bound by the inner casing as to forces in any radial direction (e.g. vertically upward or downward or horizontal in either direction or any combination thereof) after being installed into the inner casing slot along the longitudinal direction. The body bound interface between the inner casing and the support member is effective to transfer dead weight and operating loads (including rotation reaction) from the support member to the outer casing without a fixed connection between the support member and the inner casing.

Figure 5:
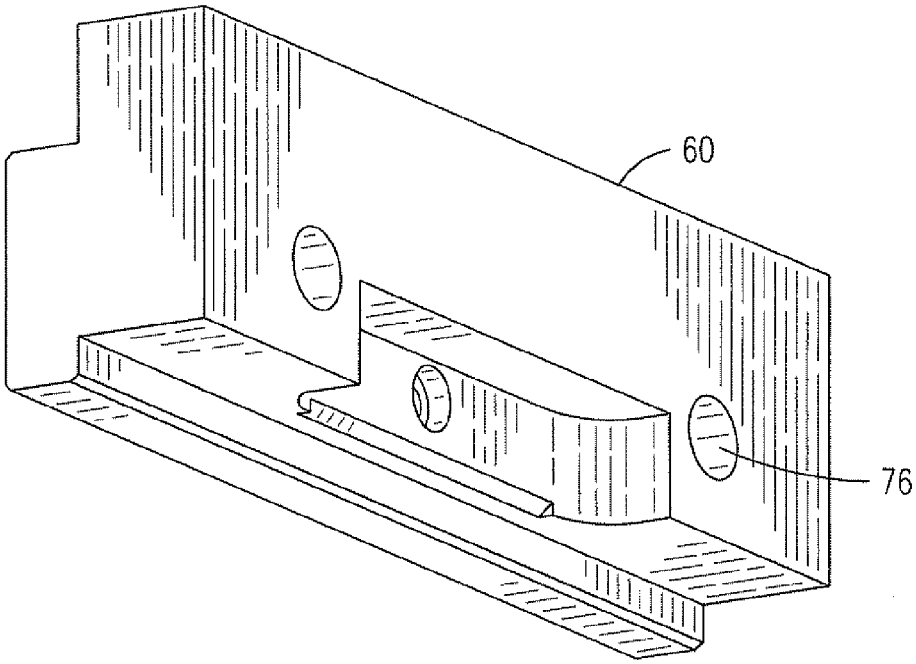
FIGS. 5 and 6 are perspective views of opposite sides of the support member of FIG. 4.
Figure 6:
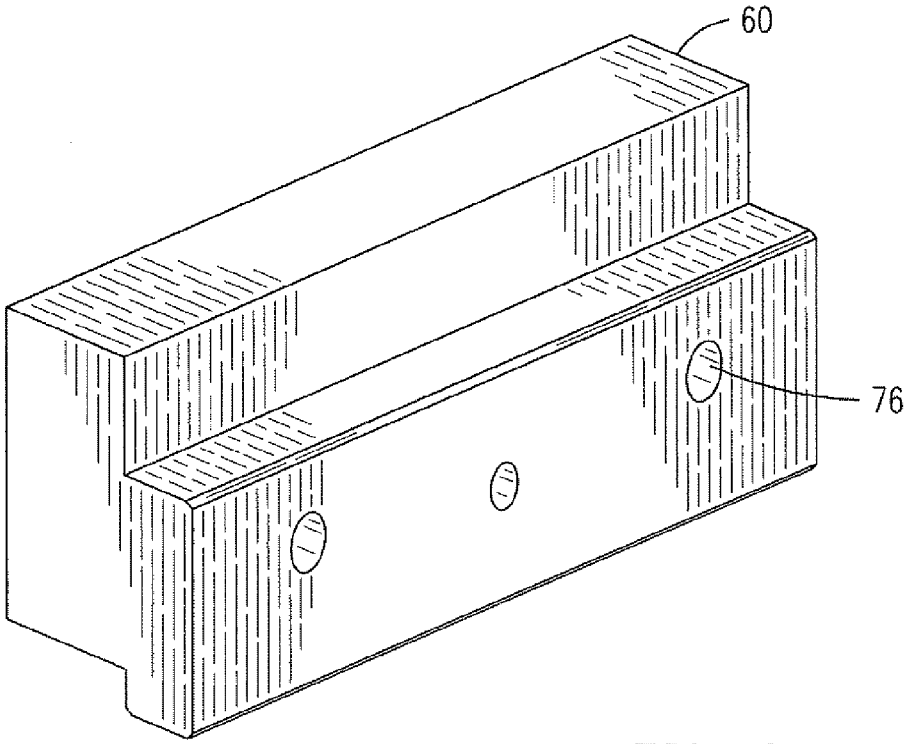
Figure 7:
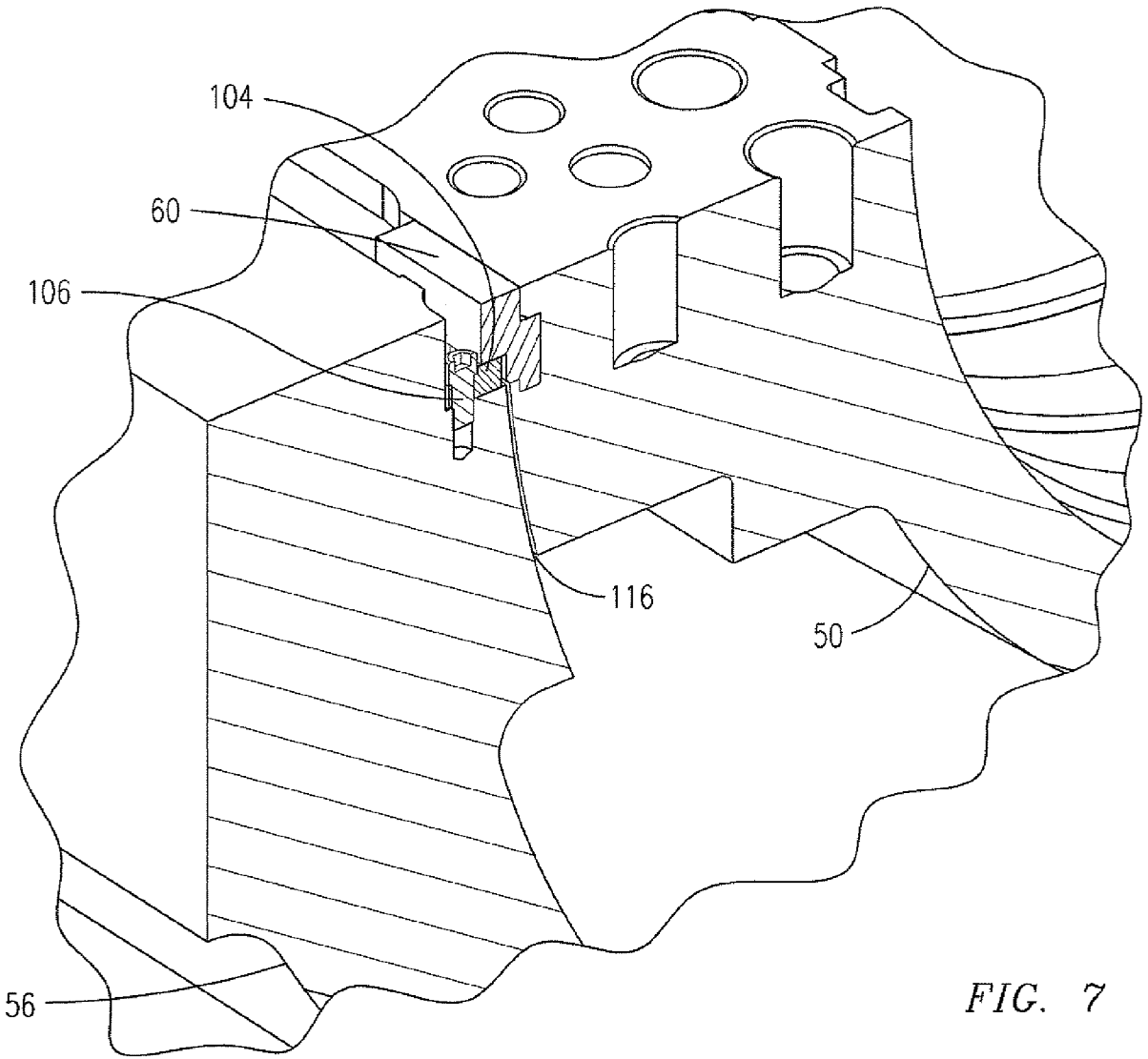
FIG. 7 is a perspective view of the centerline suspension arrangement of FIG. 4 as used in the horizontal joint flange area of a turbine.
Figure 8:
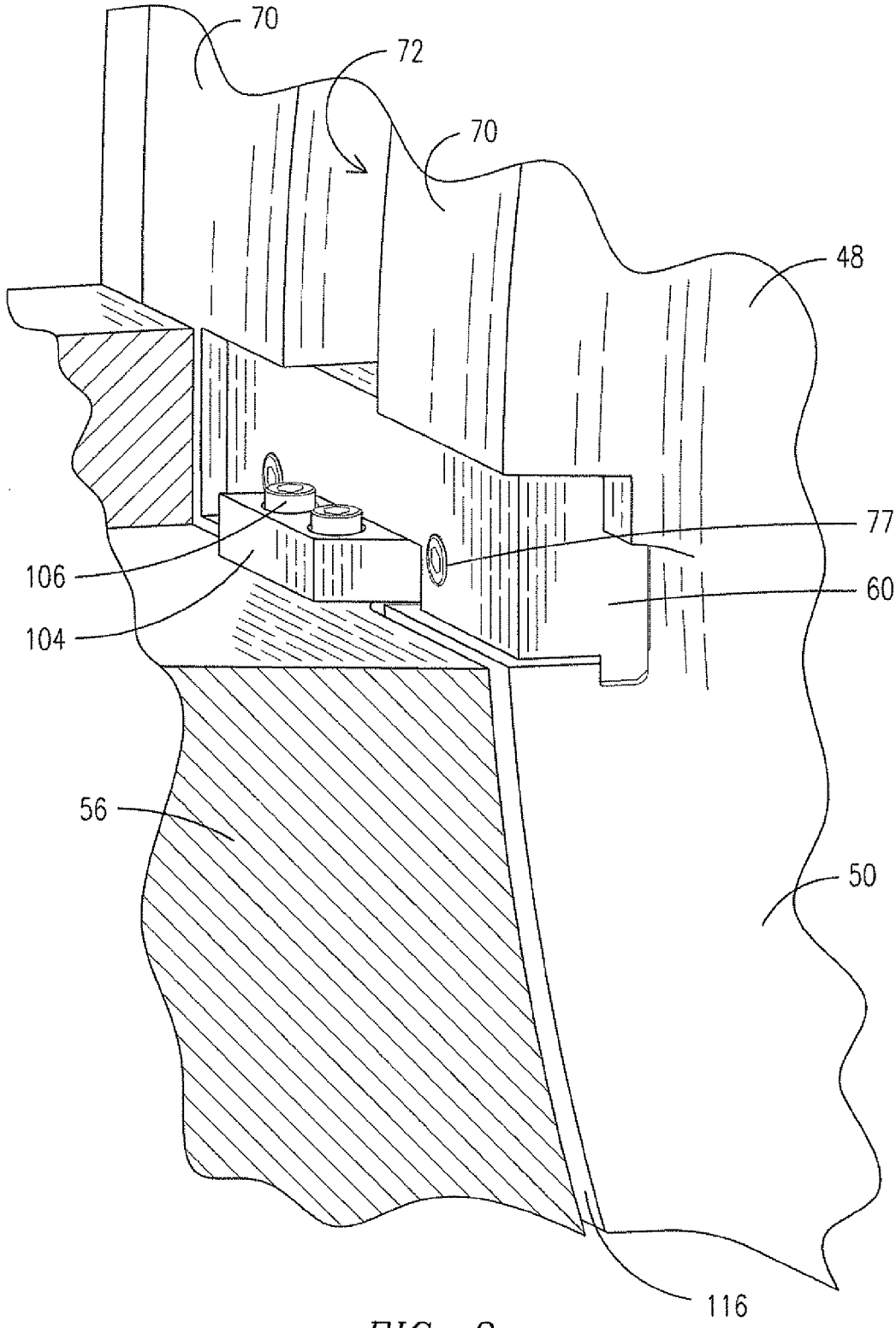
FIG. 8 is a perspective view of the centerline arrangement of FIG. 4 as used in the tongue and groove region of a turbine casing engagement.

FIGS. 5 and 6 are perspective illustrations of two sides of support member 60 and FIGS. 7 and 8 are perspective views of the turbine centerline support arrangement 42 as applied in two different locations of a turbine. FIG. 7 illustrates how the support member is installed into the inner casing slot which is formed in the horizontal joint flange. FIG. 8 illustrates how the support member is installed into the inner casing slot located in the tongue and groove area of a turbine casing engagement. In the tongue and groove area, protrusions 70 of the inner casing define a groove area 72 there between into which a tongue 74 of the outer casing extends, thus fixing both casings in the axial direction. The support member includes a plurality of holes 76 for the insertion of one or more bolts 77 or other fasteners to retain the support member within inner casing slot during transportation, assembly, or other handling of the turbine. Such optional fasteners may be installed to prevent the support member from sliding within the inner casing slot, but they are not necessary during operation of the turbine and are not considered as part of the design load path carrying dead weight and operational loads from the inner casing to the outer casing. The cross-sectional view of FIG. 4 is taken either through the tongue/groove region or across the horizontal joint flange, depending upon in which region the suspension arrangement is located. This body bound arrangement provides a rigid connection for resisting vertical dead weight loads and any resultant radial loads or moments, as well as shaft torque loadings, within the constraints of assembly tolerances. The assembly tolerances may be made as tight as practical while being sufficiently loose to facilitate the assembly of the component. In one embodiment, to establish the body bound rabbet fit there may be provided a design gap in each of the horizontal and vertical dimensions between the support member and the inner casing slot in the range of 0.01-0.03 mm to allow for sliding assembly of the components.

Referring to FIG. 4, inner casing slot 64 is composed in part, of a first protruding structure 78 including a generally vertical outwardly facing loading surface 80 for conveying horizontal loads in a first direction, a generally horizontal downwardly facing loading surface 82 for conveying vertical loads and a second protruding structure 84 including a generally vertical inwardly facing loading surface 86 for conveying horizontal loads in a second direction opposed to the first direction. The inner casing slot 64 defines the respective first and second protruding structures 78 and 84. Protruding structure 78 applies the total vertical loading to support member 60 through surface 82. Surfaces 80 and 86 support the horizontal reaction loads. The support member inner portion includes surfaces complementary to the surfaces defined by the inner casing slot, including a generally vertical inwardly facing loading surface 88 for opposing the horizontal loads of the first horizontal direction and a generally horizontal upwardly facing loading surface 90 for opposing the vertical loads and a generally vertical outwardly facing loading surface 92 for opposing the horizontal loads of the second horizontal direction. The outer portion 66 of the support member 60 includes a generally horizontal downwardly facing loading surface 94 for transferring the vertical loads to a generally horizontal upwardly facing loading surface 96 defined by the outer casing slot 68. A gap 114 is maintained between an uppermost or top surface 98 of the support member and the opposed bottom surfaces 100, 102 of the inner and outer casing to avoid contact there between.

The outer casing slot horizontal upwardly facing loading surface may be formed to contact the support member directly, or alternatively as illustrated in FIG. 4, there may be provided an outer casing lower half shim member 104 upon which the support member outer portion 66 rests. In this embodiment the support member 60 rests against the shim member 104 which in turn rests against the upwardly facing loading surface 96. Thus, the upwardly facing loading surface 96 provides a means for vertically supporting the support member outer portion 66 from the turbine outer casing 46. This shim member may be secured to the outer casing lower half within the outer casing slot by a bolt 106. This shim member may be selectively machined or otherwise formed to a desired thickness to control vertical alignment of the inner casing relative to the outer casing. Further, there may provided an outer casing upper half shim member 108 and respective retaining bolt 110 which may be formed to a desired thickness to control the size of the gap 114 between the shim member and the top surface of the support member. The bolts are used to secure the shims in position, but they do not carry the deadweight loads of the inner casing, thus they do not contribute to deflection of the inner casing relative to the outer casing. The centerline support arrangement of FIG. 4 requires no bolt or other type of fastener in the load path between the inner casing and the support member.

Figure 1:
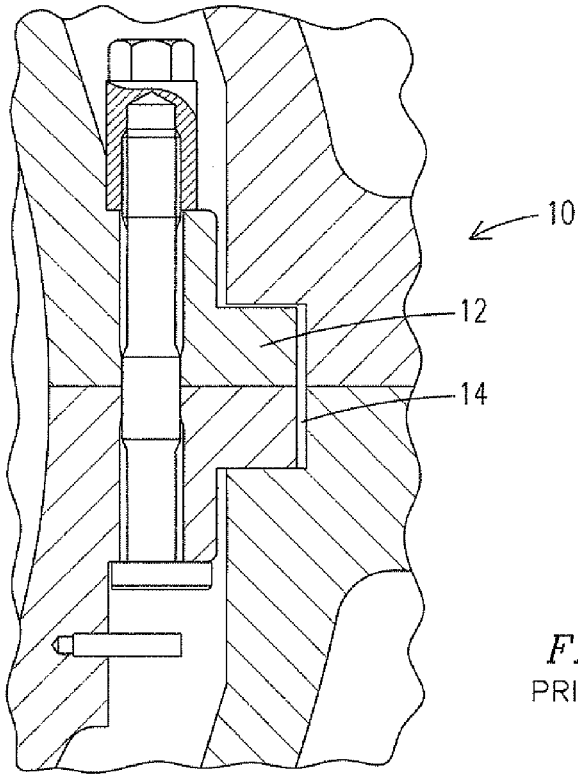
FIG. 1 PRIOR ART
FIGS. 1-3 are cross-sectional views of respective prior art centerline suspension arrangements for turbine internal components.
Figure 2:
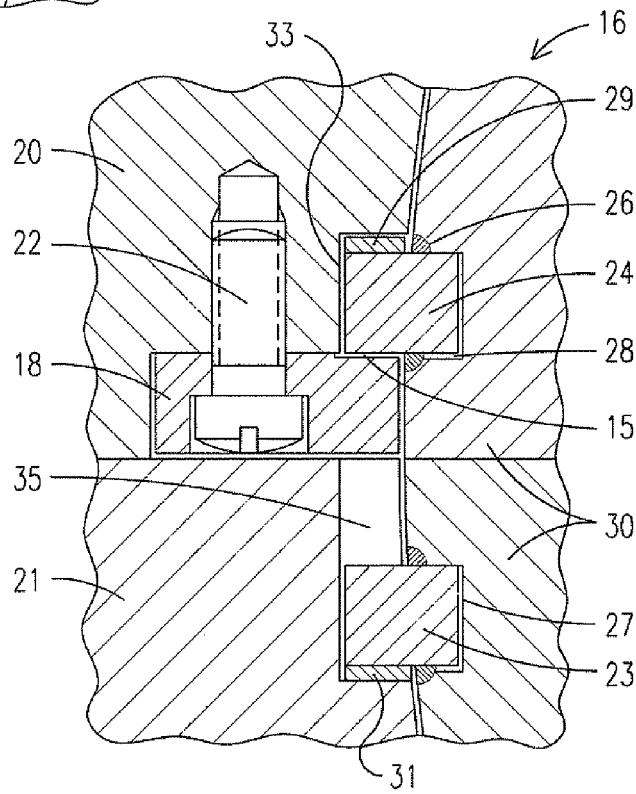
FIG. 2 PRIOR ART
Figure 3:
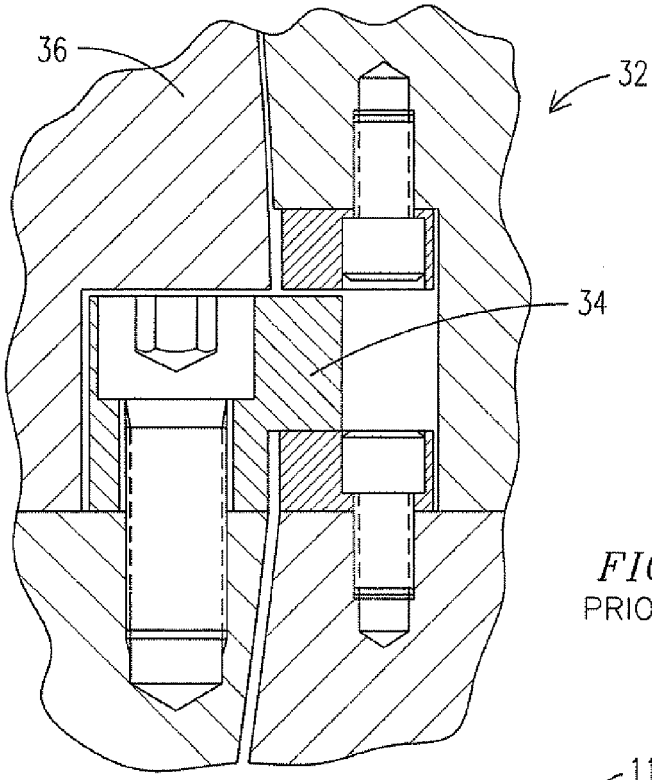
FIG. 3 PRIOR ART

The respective halves of the inner and outer casings are bolted together in a manner known in the art (not shown). The dead weight of the inner casing and other loads are transferred to the support member, which in turn bears on the outer casing. Thus, dead weight of the inner casing and other loads are carried through the protruding structure 78 of the inner casing to the support member and into the outer casing. The resultant moment loading through the support member is minimized because the horizontal distance from the protruding structure 78 to the outer casing slot horizontal upwardly facing loading surface 96 is minimized, and the moment loading is reacted through the support member as shear and compressive loads. The support member is body bound within the inner casing slot by the combination of the horizontal loading surface and the two spaced apart and oppositely facing vertical loading surfaces. Thus, unlike prior art designs that incorporate a support member, the present invention avoids the necessity of carrying the deadweight loads through a bolt or other fastener. The same is true for operating torque loads which are reacted as an increase or decrease in the magnitude of the vertical loads carried by the centerline support arrangement. Accordingly, the present invention provides a more robust and rigid connection than prior art designs using support members. Whereas one embodiment of the prior art arrangement of FIG. 3 may deflect 0.30-0.40 mm due to applied loads, plus it may be subject to bolt creep over time, the arrangement of FIG. 4 applied to the same turbine may deflect only 0.03 mm due to applied loads and would not be susceptible to bolt creep over time. Furthermore, by maintaining a gap 114 above the uppermost surface of the support member under all conditions, it is assured that all inner casing vertical loads are exerted onto the support member through the protruding structure, thereby avoiding any loading or distortion of the horizontal joint connection between the upper and lower halves of the inner or outer casings and ensuring the integrity of those connections. Relative thermal growth between the inner and outer casing is accommodated by this gap and by the gap 112 existing between the outermost edge of the support member and the generally vertical surface of the outer casing lower half slot and radial gap 116 between outer and inner casings.

The support member may be formed of high temperature chrome-moly steel, such as is known for forming turbine casings, or it may be formed of a stainless steel, for example.

While various embodiments of the present invention have been shown and described herein, it will be obvious that such embodiments are provided by way of example only. Numerous variations, changes and substitutions may be made without departing from the invention herein. For example, while the inner and outer casing slots are both illustrated as being formed in the casing lower halves, one skilled in the art will appreciate that in other embodiments the slots may be formed in the upper halves or any combination there between. In other embodiments the portion of the support member that is body bound may be located within a slot formed in the inner casing upper half or the outer casing. Further, this invention can be implemented in new turbines, or it can be installed as a retrofit to existing machines, particularly machines utilizing a horizontal support arrangement including bolted-in support members. Accordingly, it is intended that the invention be limited only by the spirit and scope of the appended claims.

The invention claimed is:

1. A centerline suspension arrangement for a turbine comprising:

an outer casing;

an inner casing;

a support member comprising an inner portion disposed within an axially oriented slot in the inner casing, the support member inner portion and inner casing slot cooperatively shaped for insertion of the support member inner portion into the slot in the axial direction and for a body bound fit between the support member inner portion and the inner casing in radial directions; and an outer portion of the support member extending beyond the inner casing slot and being vertically supported within a slot formed in the outer casing;

wherein the body bound fit between the inner casing and the support member is effective to establish a design load path for a transfer of dead weight and operating loads from the inner casing to the support member and to the outer casing without a necessity for a fixed connection between the support member and the inner casing;

further comprising the inner casing slot defining a first protruding structure comprising a generally vertical outwardly facing loading surface for conveying horizontal loads in a first direction and a generally horizontal downwardly facing loading surface for conveying vertical loads and defining a second protruding structure comprising a generally vertical inwardly facing loading surface for conveying horizontal loads in a second direction opposed the first direction; and the support member comprising a generally vertical inwardly facing loading surface for opposing the horizontal loads of the first direction and a generally horizontal upwardly facing loading surface for opposing the vertical loads and a generally vertical outwardly facing loading surface for opposing the horizontal loads of the second direction, and the outer portion of the support member comprising a generally horizontal downwardly facing loading surface for transferring the vertical loads to a generally horizontal upwardly facing loading surface defined by the outer casing slot.

2. The arrangement of claim 1, wherein the inner casing slot is formed only in a lower half portion of the inner casing.

3. The arrangement of claim 2, further comprising a gap maintained between an uppermost surface of the support member and both the inner casing upper half and the outer casing upper half.

4. The arrangement of claim 3, wherein the outer casing upper half comprises an outer casing upper half shim member comprising a desired thickness to control a dimension of the gap between the uppermost surface of the support member and the outer casing upper half.

5. The arrangement of claim 1, further comprising an outer casing lower half shim member disposed within the outer casing slot between the generally horizontal upwardly facing loading surface and the generally horizontal downwardly facing loading surface of the support member outer portion, the outer casing lower half shim member comprising a desired thickness to control vertical alignment of the inner casing relative to the outer casing.

6. The arrangement of claim 1, further comprising a design gap in each of the horizontal and vertical dimensions between the support member and the inner casing slot in the range of 0.01-0.03 mm in order to establish a body bound rabbet fit and to allow for sliding insertion of the support member into the inner casing slot.

7. The arrangement of claim 1, further comprising a fastener connected between the support member and the inner casing to maintain the support member within the slot during handling of the turbine, the fastener not forming part of the design load path for the transfer of dead weight and operating loads.

8. A centerline suspension arrangement for a turbine comprising:

an outer case upper half joined to an outer case lower half along a horizontal joint;

an inner case upper half joined to an inner case lower half along a horizontal joint;

a generally axially oriented first slot formed in an outer portion of the inner case lower half and defining a first protruding structure comprising a generally vertical outwardly facing loading surface for conveying horizontal loads in a first direction and a generally horizontal downwardly facing loading surface for conveying vertical loads and defining a second protruding structure comprising a generally vertical inwardly facing loading surface for conveying horizontal loads in a second direction opposed the first direction;

a support member comprising an inner portion cooperatively formed relative to the first slot for a body bound interconnection between the inner portion and the first slot effective to transfer dead weight and torque loads between the inner portion and the first slot, the support member further comprising an outer portion extending from the inner portion; and a second slot formed in an inner portion of the outer case lower half for receiving the support member and defining a vertically upward facing surface for vertically supporting the support member outer portion in response to the dead weight and torque loads.

9. The arrangement of claim 8, further comprising a bolt attached between the support member and the inner case lower half for maintaining the support member at a fixed axial location within the first slot.

10. The arrangement of claim 8, further comprising an outer case lower half shim member disposed within the second slot under the support member outer portion for supporting the inner case lower half with a predetermined vertical alignment relative to the outer case lower half.

11. The arrangement of claim 10, further comprising an outer case upper half shim member attached to the outer case upper half and disposed above the support member outer portion to define a gap of a predetermined dimension between the outer case upper half shim member and the support member outer portion.

12. A centerline suspension arrangement between an inner component and an outer case of a turbine, the arrangement comprising:

a support member comprising an inner portion and an outer portion;

a means for capturing the support member inner portion within the turbine inner component; and a means for vertically supporting the support member outer portion from the turbine outer case wherein a body bound fit is achieved between the support member inner portion and the inner component in radial directions without a necessity for fixed connection between the support member and the inner component;

the support member inner portion comprises a generally vertical inwardly facing loading surface and a generally horizontal upwardly facing loading surface and a generally vertical outwardly facing loading surface, and the support member outer portion comprises a generally horizontal downwardly facing loading surface; and the means for capturing the support member inner portion comprises a longitudinally oriented slot formed in the inner component, the slot defining a first protruding structure comprising a generally vertical outwardly facing loading surface for conveying horizontal loads in a first direction to the support member generally vertical inwardly facing loading surface, and defining a generally horizontal downwardly facing loading surface for conveying vertical loads to the support member generally horizontal upwardly facing loading surface, the slot also defining a second protruding structure comprising a generally vertical inwardly facing loading surface for conveying horizontal loads in a second direction opposed the first direction to the support member generally vertical outwardly facing loading surface.

* * * * *